United States Patent [19]

Longsderff et al.

[11] 4,357,368

[45] Nov. 2, 1982

[54] METHOD OF MAKING A PHOTOSENSITIVE ELECTRODE AND A PHOTOSENSITIVE ELECTRODE MADE THEREBY

[75] Inventors: Richard W. Longsderff; Dale V. Henry, both of Lancaster, Pa.

[73] Assignee: RCA Corporation, New York, N.Y.

[21] Appl. No.: 973,455

[22] Filed: Dec. 26, 1978

[51] Int. Cl.[3] ..... H01J 9/12; H01J 40/06

[52] U.S. Cl. ..... 427/74; 316/3; 316/5; 316/6; 427/107; 427/237; 427/250; 264/15

[58] Field of Search ..... 427/78, 250, 107, 237, 427/74; 316/3, 5, 6; 264/15

[56] References Cited

U.S. PATENT DOCUMENTS

| | | | |
|---|---|---|---|
| 1,991,774 | 2/1935 | Spencer | 427/107 |
| 2,065,570 | 12/1936 | Essig | 250/27.5 |
| 2,149,977 | 3/1949 | Morton | 250/167 |
| 2,289,978 | 7/1942 | Malter | 250/164 |
| 2,432,657 | 12/1947 | Colbert | 427/250 |
| 2,450,856 | 10/1948 | Colbert | 427/250 |
| 2,685,331 | 8/1974 | Rodda | 427/78 |
| 2,770,561 | 11/1956 | Sommer | 427/74 |
| 2,776,227 | 1/1957 | Hoffman et al. | 117/210 |
| 2,975,075 | 3/1961 | Beese | 427/107 |
| 3,018,193 | 1/1962 | Eshner | 316/5 |
| 3,063,099 | 11/1962 | Turner | 264/15 |
| 3,152,246 | 10/1974 | van deuren | 427/78 |
| 3,658,400 | 4/1972 | Helvy | 117/33.5 CP |
| 3,729,342 | 4/1973 | Te Velde | 117/217 |
| 3,739,216 | 6/1973 | Pakswer | 427/78 |
| 3,753,023 | 8/1973 | Sommer | 427/78 |
| 3,884,539 | 5/1975 | Sommer | 117/215 |

*Primary Examiner*—John D. Smith

*Attorney, Agent, or Firm*—Eugene M. Whitacre; Glenn H. Bruestle; Vincent J. Coughlin, Jr.

[57] ABSTRACT

A film of photoemissive material, such as antimony, is vaporized from a platinum-antimony source onto a substrate in an enclosure. The source is preferably a plurality of beads formed by attaching substantially spherical particles of platinum-antimony (50—50 by atomic volume) to a platinum-clad molybdenum wire. The spherical particles are accurately sized so that each bead comprises substantially the same amount of antimony. The beads are symmetrically arranged about the substrate so that upon evaporation a substantially uniform film of photoemissive material is deposited on the substrate.

7 Claims, 6 Drawing Figures

METHOD OF MAKING A PHOTOSENSITIVE ELECTRODE AND A PHOTOSENSITIVE ELECTRODE MADE THEREBY

BACKGROUND OF THE INVENTION

1. Field of the Invention

This invention relates to the art of making photosensitive electrodes and, in particular, to the techniques utilized to vapor deposit films of photoemissive material in forming a photocathode.

2. Description of the Prior Art

It is known (see for example U.S. Pat. No. 2,770,561 to Sommer, issued Nov. 13, 1956) to form a photocathode by providing an electron-emitting surface, such as a film of antimony activated or sensitized with one or more alkali metals, on a substrate, such as glass. The antimony film, as well as the layers of alkali metals, are typically obtained by vapor deposition from a source of material suitably disposed near the inside faceplate of the tube. This source of material, in the case of antimony, is generally several beads of platinum-antimony alloy, comprising about 50% antimony and 50% platinum, by atomic volume in accordance with the phase diagram for this alloy. The beads are formed by attaching, as by melting in a hydrogen atmosphere, particles of platinum-antimony to a platinum-clad molybdenum or tungsten wire.

The platinum-antimony alloy is generally prepared in a large billet under very controlled cleanliness conditions. This billet is then crushed into particles for later attachment to the platinum-clad molybdenum wire. Because the alloy is crystalline, the breakage of the billet is along particular grain boundaries of the alloy and the resulting particles are very irregular in shape and size. Screening these particles to a specific size or weight to obtain a controlled amount of deposited antimony is extremely difficult and where high volume is concerned, virtually impossible. In addition, attaching these particles to the wire creates further problems. The particles are attached by heating the wire to a selected temperature and then touching the particles to the heated wire. Due to the irregular shapes, melting and alloying of the particles to the wire is non-uniform and sporadic, causing the particles to spread out along the wire. This results in excess alloying and embrittlement of the wire making it difficult to handle the wire for mounting in the tube.

Since it is very difficult in photocathode processing to control the uniformity of the antimony deposition or to know the precise amount evaporated because of the irregular size or shape of the particles used to form the beads, a determination of the antimony thickness is made in the art by measuring the light transmission through the film. This light transmission measurement is generally done in a manner disclosed by Polkosky in U.S. Pat. No. 2,676,282, issued on Apr. 20, 1954. Curves are available that relate the light transmission to the thickness of the antimony film. Generally, more antimony than needed is included in the beads and when the desired light transmission ratio is obtained, the evaporation of the bead is stopped, leaving unevaporated antimony in the beads. Significant discrepancies in tube performances have, however, indicated an uncertainty regarding the accuracy of the light transmission-antimony thickness curves. In various tests performed to evaluate these curves, it has been found that for a given light transmission, the antimony thickness values may differ almost by a factor of two, due in part to the nonuniformity of the antimony film deposition.

It is thus apparent that more uniform and accurate film deposition techniques for forming photosensitive surfaces are desirable.

SUMMARY OF THE INVENTION

A method is provided for making a photosensitive electrode including the step of vaporizing from a source containing a photoemissive material a film of photoemissive material onto a substrate in an enclosure. The source is formed to include a predetermined amount of photoemissive material that is arranged symmetrically about the substrate. The photoemissive material is evaporated to deposit a substantially uniform film on the substrate. Also provided is a photosensitive electrode formed by this method.

DETAILED DESCRIPTION OF THE PREFERRED EMBODIMENT

Figure 1:
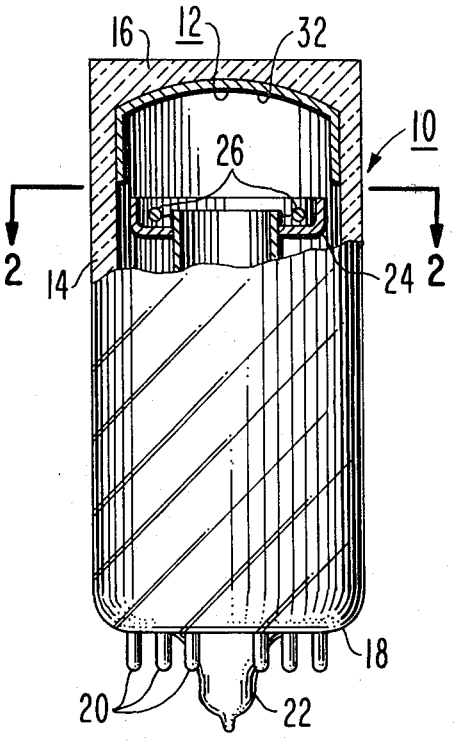
FIG. 1 is an elevation view, partly in section, of a photomultiplier tube having a photosensitive surface formed according to the present method.

FIG. 1 shows a photomultiplier tube 10 comprising an electron multiplier (not shown) and a photosensitive cathode 12 made in accordance with the present novel method. The photomultiplier tube 10 is utilized herein by way of example, it being understood that the present invention may be applied to any device incorporating a photosensitive electrode.

The tube 10 has a cylindrical glass envelope 14 that is closed on one end by a transparent faceplate 16. The other end of the tube 10 is closed by a glass stem 18 having a number of electrical lead-in pins 20 and an exhaust tubulation 22, shown as being "tipped off". Mounted within a substantially cup-shaped shield 24 and adjacent the faceplate 16 are beads 26 comprising a source of material used to form a photoemissive surface, such as antimony. In addition to antimony, other materials that may be used to form photoemissive surfaces when reacted with alkali metals and oxides of themselves are tellurium, bismuth and silver. Such materials, referred to herein as "photoemissive materials", may be used in the practice of the present novel method. As described hereinafter, antimony from the beads 26 is deposited onto the inner surface of the faceplate 16 and a portion of the sidewall at the envelope 14. The shield 24 confines the antimony to a preselected area at the upper end of the tube 10.

Figure 2:
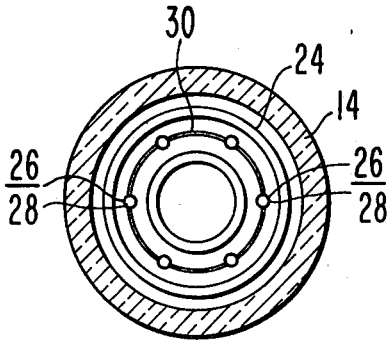
FIG. 2 is a sectional view of the photomultiplier tube of FIG. 1 as seen along section lines 2—2.

As shown in FIG. 2, a wire 30 is arranged preferably in substantially circular form within the shield 24 and substantially concentric with the inside of the envelope 14 so that the beads 26 are symmetrical about the faceplate 16. A plurality of substantially equally spaced beads 26 are preferably attached to the wire 30 to provide a substantially uniform deposition of antimony. Each of the beads 26 comprises a substantially spherical particle 28 attached to a wire 30 according to a novel method of forming the beads 26. The spheres 28 are selected to be of substantially equal diameter. It is preferred that the spherical particles 26 be formed of a platinum-antimony alloy comprising about 50% antimony and 50% platinum, by atomic volume. The wire 30 is preferably a platinum-clad molybdenum wire but may also be a nickel or a platinum-plated tungsten wire.

In the forming of a photosensitive surface on a substrate, i.e., the inside wall of the upper end of the envelope 14 and the inside surface of the faceplate 16, the tube 10 is first evacuated until the pressure in the envelope 14 is in the order of about $10^{-6}$ Torr or less. Next, a current is passed through the wire 30 which is connected to a pair of lead-in pins 20 to which an appropriate voltage source (not shown) is attached in order to heat the wire 30 to a sufficiently high temperature to evaporate antimony from the antimony-platinum beads 26. The platinum has a vapor pressure somewhat lower than the vapor pressure of antimony, hence the platinum is not evaporated with the antimony.

According to the present method, the evaporation of antimony is continued until the antimony in the bead 26 is substantially depleted. The thickness of the film 32 of antimony deposited onto the substrate is determined by the amount of antimony that is contained in the spherical particles 28 attached to the wire 30. By knowing the surface area of the substrate that the shield 24 confines the deposition to, the thickness of the film 32 can be ascertained by knowing the volume of antimony in the spherical particles 28. Measurement of light transmission through the film 32 to determine the thickness of the film 32 is not required. Also, since the symmetrically arranged beads 26 are about the same size, the amount of antimony evaporated from each bead 26 will be nearly equal, resulting in a substantially uniform deposit over the substrate. Once the film 32 has been deposited, the antimony film 32 may then be sensitized or reacted with layers of alkali metals and additional films of antimony to achieve desired electron emission or sensitivity levels according to known photosensitizing techniques such as described, for example, in U.S. Pat. No. 3,658,400 issued on Apr. 25, 1972 or U.S. Pat. No. 3,884,539 issued on May 20, 1975.

Figure 3:
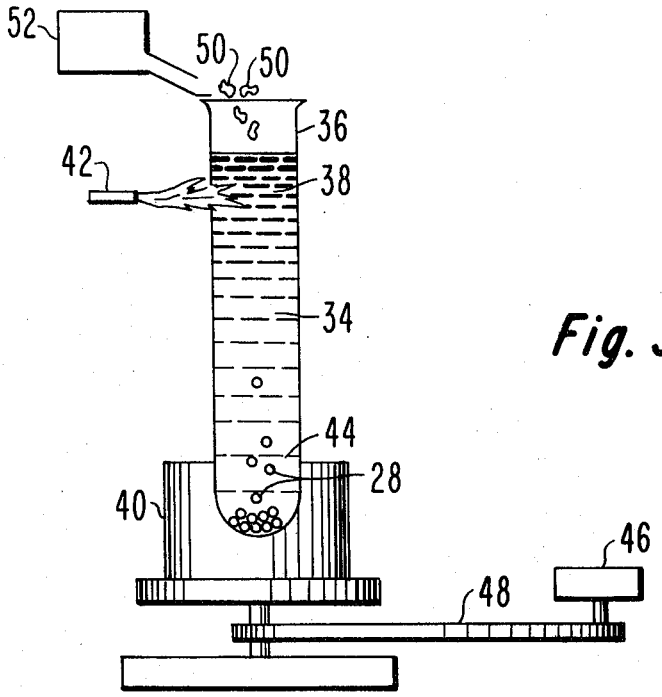
FIG. 3 is a schematic view of an apparatus utilized to spherize irregular particles of photoemissive material.

The formation of the beads 26 to have a predetermined amount of antimony is obtained by the use of spherical particles 28 that are formed to very accurate dimensions. A commercially available process of forming the spherized particles 28 is shown schematically in FIG. 3. This is known as the liquid salts bath process. In this process, a solution 34 of liquid salts is contained in a quartz crucible 36 supported in a block 40. The top 38 of the solution 34 is heated, as by an acetylene torch 42, so that the temperature of the solution at the top 38 is about 1200° C. The bottom 44 of the solution 34 is typically about 8 inches (20.3 cm.) from the heated top 38 of the solution 34. At this spacing, a natural temperature gradient exists in the solution 34 such that the bottom 44 is at a temperature of less than 1000° C. when the top 38 is at a temperature of about 1200° C. The crucible 36 may be rotated as by a drive motor 46 and mechanism 48 so as to uniformly heat the portion 38 of the solution 34. Irregular particles 50, formed as by crushing a billet of platinum-antimony, as described in the prior art section, are stored above the crucible 36 in a bin 52. In this process, the irregular particles 50 are dropped into the solution 34 and allowed to drop through the solution 34. Since the melting point of platinum-antimony alloy is approximately 1080° C., the irregular particles 50 will melt upon entry into the heated solution 38 and become spherical due to their surface tension. As the particles pass into the cooler solution 44, below the melting point of the particles, the particles 28, which are not spherical, solidify and collect on the bottom of the crucible 36.

Figure 4:
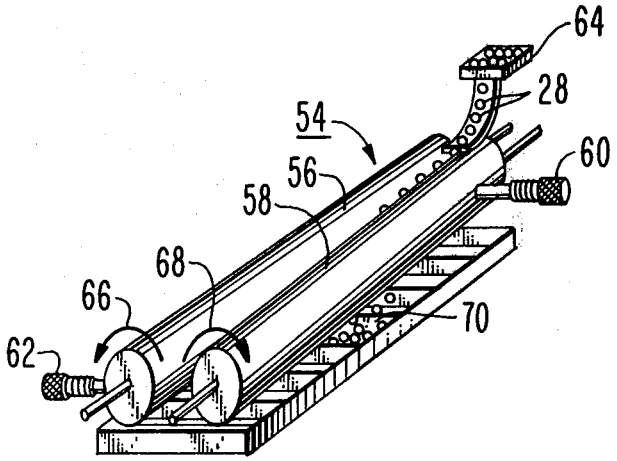
FIG. 4 is a view in perspective of an apparatus used to size the spherical particles formed in the apparatus of FIG. 3.

The spherical particles 28, upon removal from the salts bath, are then sized according to their diameters. A method of sizing the spherical particles 28 by roller-micrometer is shown in FIG. 4. As is known, the roller-micrometer 54 is an apparatus that can be used for accurate measurement of spheres. The roller-micrometer 54 comprises two rollers 56 and 58 which can be adjusted to control the spacing between them. One end of the rollers is adjusted, as by a micrometer 60 to have a minimum spacing and the other end adjusted by a micrometer 62 to have a maximum opening. For example, if spheres on the order of 0.019 inches (0.483 mm) are desired, the minimum spacing may be adjusted for 0.017 inches (0.432 mm) and the maximum set at 0.021 inches (0.533 mm). The spheres 28 are stored in a container 64 above the end of the roller-micrometer 54 having the minimum spacing between the rollers 56 and 58. The rollers are rotated in a direction away from each other as shown by the arrows 66 and 68 and the spheres 28 to be sized are fed into the gap between the rollers at the close end. The spheres 28 advance down the rollers until an opening equivalent to their diameter is reached and fall through the rollers 56 and 58 to a box 70 marked with the appropriate diameter. It is possible to measure the diameter of these spheres 28 using this technique to within several ten thousanths of an inch (several microns).

Figure 5A:
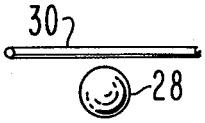
FIGS. 5(*a*) and 5(*b*) illustrate the formation of a substantially uniform bead by attaching spherical particles to a wire according to the present method.
Figure 5B:
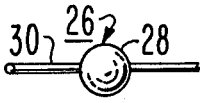

Having sized the spheres 28, spheres of a particular and accurate diameter may be selected for formation of the bead 26. The bead is formed, as shown in FIGS. 5(*a*) and 5(*b*) by heating the wire 30 to a temperature above the melting point of the sphere 28. Where the sphere 28 is the platinum-antimony alloy having the melting point of 1080° C., and the wire 30 is platinum-clad molybdenum, the wire 30 is heated to about 1200° C. in a reducing atmosphere, such as hydrogen. The sphere 28 is then brought into contact with the heated wire 30. The sphere 28 melts and by mutual wetting action of the platinum in the wire 30 and the sphere 28, the sphere 28 flows around the wire 30. A bead 26 is formed that is substantially uniform, having a known quantity of antimony compared to the unknown quantity of antimony contained in beaded wire assemblies formed with an irregular shaped platinum-antimony particle.

Although the novel method of forming a photosensitive electrode has been described herein as one in which the photoemissive material in the beads 26 is evaporated to completion, it should be understood that the beads 26 comprising spheres 28 of known amounts of antimony may also be used for their capability of forming substantially uniform deposits without evaporation to depletion. Light transmission techniques may be used to monitor the deposition thickness. These measurements may be more accurate than those of the prior art in view of the fact that the antimony in the present method is deposited substantially uniformly in all directions. In certain photosensitive electrode processing, repetitive depositions of antimony films and alkali metals are required to achieve optimum sensitivity. By using a plurality of beads 26 having spheres 28 that are substantially equally spaced, each sphere 28 being approximately the same size and having thereby an equivalent content of antimony, a film of antimony can be deposited substantially uniformly onto the substrate. All these spheres 28 will vaporize at nearly the same temperature and evaporate about the same amount of antimony during a given period of time. Subsequent vaporizations will continue to be nearly uniform since all the spheres 28 will have been reduced in antimony content about the same amount. This uniformity is desirable since electrons emitted from the uniformly formed photoemissive surface will be more evenly distributed, thus enhancing the quality of the tube performance.

What is claimed is:

1. In a method of making a photosensitive electrode including the step of vaporizing a source containing photoemissive material to form a film of photoemissive material onto a substrate in an enclosure, wherein the improvement comprises:

forming said source to include a predetermined amount of photoemissive material in the shape of spherical particles having substantially the same diameter and which are attached as uniform beads to a wire;

arranging said source so that the photoemissive material is distributed substantially symmetrical about said substrate; and evaporating the photoemissive material to deposit a substantially uniform film onto said substrate.

2. A method according to claim 1, wherein said photoemissive material is selected from the group consisting of antimony, tellurium, bismuth and silver.

3. A method according to claim 1, wherein said source of photoemissive material is a plurality of beads formed by:

spherizing a plurality of particles containing photoemissive material;

selecting the spherical particles as by sizing their diameters so that each spherical particle has substantially the same diameter and thereby an equivalent amount of photoemissive material; and attaching said spherical particles to a wire.

4. A method according to claim 3, wherein said substrate is substantially circular and said photoemissive material is symmetrically arranged about said substrate by forming said wire in a circle substantially concentric with said substrate; and spacing said spherical particles substantially evenly around said circularly formed wire.

5. A method according to claim 3, wherein said spherical particles are attached by:

heating said wire to a temperature above the melting point of the particles in a reducing atmosphere; and contacting said particles to said heated wire to thereby melt said particle around said wire.

6. A method according to claim 5, wherein said particles are alloys comprising approximately 50% platinum and approximately 50% antimony, by atomic volume and wherein said wire is platinum-clad molybdenum heated to a temperature of about 1200° C.

7. In a method of making a photosensitive electrode including vaporizing a source containing photosensitive material to deposit a substantially uniform film of photosensitive material onto a substrate in an enclosure, wherein an improved source is formed by the steps of:

spherizing a plurality of particles of an alloy comprising approximately 50% platinum and approximately 50% antimony, by atomic volume;

selecting spherical particles having substantially the same diameter and thereby an equivalent amount of photosensitive material; and attaching said selected spherical particles to a platinum-clad molybdenum wire by heating said wire to a temperature of about 1200° C. in a reducing atmosphere and contacting said spherical particles to said heated wire to thereby melt said particle around said wire and form a substantially uniform bead having a known quantity of antimony.

* * * * *

UNITED STATES PATENT AND TRADEMARK OFFICE

CERTIFICATE OF CORRECTION

PATENT NO. : 4,357,368

DATED : November 2, 1982

INVENTOR(S) : Richard W. Longsderff et al.

It is certified that error appears in the above-identified patent and that said Letters Patent is hereby corrected as shown below:

Column 4, Line 7 - "not" should read -- now -- .

Signed and Sealed this

*Eighth* Day of *March 1983*

[SEAL]

*Attest:*

GERALD J. MOSSINGHOFF

*Attesting Officer*

*Commissioner of Patents and Trademarks*